US010843906B2

(12) United States Patent
Ikeuchi et al.

(10) Patent No.: US 10,843,906 B2
(45) Date of Patent: Nov. 24, 2020

(54) ADJUSTING DEVICE FOR OPERATING MACHINES

(71) Applicant: TADANO LTD., Kagawa (JP)

(72) Inventors: Nanami Ikeuchi, Kagawa (JP); Hiroaki Kusanagi, Kagawa (JP)

(73) Assignee: TADANO LTD., Kagawa (JP)

( * ) Notice: Subject to any disclaimer, the term of this patent is extended or adjusted under 35 U.S.C. 154(b) by 2 days.

(21) Appl. No.: 15/559,191

(22) PCT Filed: Feb. 18, 2016

(86) PCT No.: PCT/JP2016/000845
§ 371 (c)(1),
(2) Date: Sep. 18, 2017

(87) PCT Pub. No.: WO2016/152011
PCT Pub. Date: Sep. 29, 2016

(65) Prior Publication Data

US 2018/0079630 A1 Mar. 22, 2018

(30) Foreign Application Priority Data

Mar. 23, 2015 (JP) ..... 2015-059701

(51) Int. Cl.
*B66C 13/42* (2006.01)
*B66C 13/40* (2006.01)
*B66C 13/16* (2006.01)

(52) U.S. Cl.
CPC ..... *B66C 13/42* (2013.01); *B66C 13/16* (2013.01); *B66C 13/40* (2013.01)

(58) Field of Classification Search
CPC . E02F 9/26; E02F 9/267; E02F 9/2296; E02F 9/24; E02F 9/2054; E02F 9/2066;
(Continued)

(56) References Cited

U.S. PATENT DOCUMENTS 5,913,911 A * 6/1999 Beck ..... B63B 49/00 701/1
6,804,827 B1 * 10/2004 Furukawa ..... H04H 60/04 348/569

(Continued)

FOREIGN PATENT DOCUMENTS

CN 1367575 A 9/2002
JP 2000-296985 A 10/2000

(Continued)

OTHER PUBLICATIONS

Oct. 24, 2018, European Search Report issued for related EP application No. 16767924.0.

(Continued)

*Primary Examiner* — Jean Paul Cass

(74) *Attorney, Agent, or Firm* — Paratus Law Group, PLLC

(57) ABSTRACT

An adjusting device for operating machines is equipped with: a control unit; input units connected to the control unit; and a display unit connected to the control unit. The control unit stores the item ID and adjustment value of each of a plurality of adjustment items. Upon receiving a change operation, the control unit changes the adjustment value of a specified adjustment item to a specified value. Upon receiving a change end operation, the control unit displays, on the display unit, the item ID and the adjustment value corresponding to the adjustment item with the adjustment value changed.

5 Claims, 8 Drawing Sheets

(58) Field of Classification Search
CPC ..... E02F 9/261; H04N 21/4854; H04N 7/18; H04N 17/045; H04N 21/42692; H04N 21/4316; H04N 5/57; B60K 35/00; B60R 1/00; G06Q 10/20; Y10T 74/19251
USPC ..... 701/1, 29.6, 33.4, 50, 56; 700/83, 282; 715/809; 726/7; 607/60; 324/750.01; 318/143, 553, 569, 588, 625, 660; 358/1.9, 1.14; 340/439; 477/52
See application file for complete search history.

(56) References Cited

U.S. PATENT DOCUMENTS

2004/0030367 A1* 2/2004 Yamaki ..... A61B 1/0005 607/60
2005/0036164 A1* 2/2005 Hiroe ..... G06K 15/00 358/1.9
2005/0167206 A1 8/2005 Maccioni et al.
2006/0200283 A1* 9/2006 Furuno ..... B66C 13/16 701/29.6
2006/0244864 A1* 11/2006 Hayashi ..... H04N 5/445 348/588
2007/0111851 A1* 5/2007 Fukasawa ..... F16H 61/462 477/52
2007/0195200 A1* 8/2007 Lim ..... H04N 5/57 348/625
2007/0213855 A1* 9/2007 Furuno ..... E02F 9/26 700/83
2008/0180523 A1* 7/2008 Stratton ..... G09B 9/048 348/114
2009/0055062 A1* 2/2009 Tsukada ..... E02F 9/2253 701/56
2010/0110297 A1* 5/2010 Kameoka ..... H04N 5/44513 348/569
2010/0161175 A1* 6/2010 Yamada ..... E02F 9/26 701/33.4
2012/0127366 A1* 5/2012 Lim ..... H04N 5/57 348/553
2012/0200868 A1* 8/2012 Ikeda ..... G06K 15/027 358/1.9
2012/0206493 A1* 8/2012 Koike ..... H04N 21/431 345/660
2012/0232704 A1* 9/2012 Novak ..... B66C 13/40 700/282
2012/0245760 A1* 9/2012 Ikeya ..... B60R 1/00 701/1
2013/0057305 A1* 3/2013 Jimbo ..... B60L 11/005 324/750.01
2013/0088593 A1* 4/2013 Ishimoto ..... E02F 9/226 348/143
2013/0342340 A1* 12/2013 Nishikawa ..... E02F 9/26 340/439
2014/0204408 A1* 7/2014 Iwashima ..... H04N 1/00344 358/1.14
2015/0020026 A1* 1/2015 Miyamoto ..... E02F 9/26 715/809
2015/0025753 A1* 1/2015 Mori ..... E02F 9/2066 701/50
2015/0084572 A1* 3/2015 Tanaka ..... G05B 11/42 318/568.1
2015/0314684 A1* 11/2015 Kronberg ..... B60K 28/02 340/439
2015/0361640 A1* 12/2015 Faivre ..... B62D 6/002 701/50
2015/0368876 A1* 12/2015 Nakagaki ..... E02F 3/438 701/50
2015/0373545 A1* 12/2015 Miura ..... E02F 9/2054 726/7
2016/0224948 A1* 8/2016 Morishita ..... G06Q 10/20
2016/0226977 A1* 8/2016 Fujiwara ..... H04L 67/06
2016/0327935 A1* 11/2016 Kawai ..... G05B 19/4065
2017/0018012 A1* 1/2017 Shinohara ..... G06Q 30/0283
2017/0030054 A1* 2/2017 Okumura ..... H04N 5/247
2018/0024510 A1* 1/2018 Matsushima ..... G05B 13/027 700/48
2018/0079630 A1* 3/2018 Ikeuchi ..... B66C 13/42
2018/0167588 A1* 6/2018 Izumikawa ..... E02F 9/26
2019/0142307 A1* 5/2019 Hapola ..... A61B 5/7267 600/595
2019/0154439 A1* 5/2019 Binder ..... G01S 15/08
2019/0164361 A1* 5/2019 Eggert ..... G07C 5/02

FOREIGN PATENT DOCUMENTS

JP 2002-149205 A 5/2002
JP 2004-165728 A 6/2004
JP 2009-194956 A 8/2009

OTHER PUBLICATIONS

ABB AB Crane Systems, Firmware Manual ACC800 CraneDrive application program 7.43 (+N652), Sep. 15, 2010, pp. 1-236, XP55514892AI.

* cited by examiner

ADJUSTMENT VALUE TABLE
52

| ITEM NUMBER | ITEM NAME | ADJUSTMENT VALUE | LAST ADJUSTMENT VALUE |
|---|---|---|---|
| c1 | MAXIMUM ENGINE ROTATIONAL FREQUENCY | 1.5 | 1.5 |
| c2 | MIDDLE ENGINE ROTATIONAL FREQUENCY | 1.2 | 1.2 |
| c3 | LOW ENGINE ROTATIONAL FREQUENCY | 0.9 | 0.9 |
| c4 | IDLE ENGINE ROTATIONAL FREQUENC | 0.8 | 0.6 |
| c5 | HOIST DOWN ADJUSTMENT IN HOOK OUT | 3.0 | 2.0 |
| c6 | RAISING ADJUSTMENT IN HOOK OUT | 3.0 | 3.0 |
| c7 | TURNING ADJUSTMENT IN HOOK IN/OUT | 4.0 | 4.0 |
| c8 | FIXED HEIGHT | 4.0 | 3.0 |
| c9 | ROOT HEIGHT OFFSET | 0.0 | 0.0 |
| c10 | WINCH DRUM ROTATION SPEED ZERO ADJUSTMENT | 50.0 | 50.0 |
| c11 | CONTRACTION, LOWERING PUMP DISCHARGE AMOUNT COEFFICIENT OF PARALLEL AND HORIZONTAL MOVEMENT | 0.80 | 0.80 |
| c12 | OFFSET GENTLY RAISED STOP TIME OF PARALLEL AND HORIZONTAL MOVEMENT | 2.00 | 2.00 |
| c13 | LOWERING, TURNING OPERATION AMOUNT LIMITATION OF PARALLEL AND HORIZONTAL MOVEMENT | 4.0 | 4.0 |
| c14 | RAISING OPERATION AMOUNT LIMITATION OF PARALLEL AND HORIZONTAL MOVEMENT | 3.0 | 3.0 |
| ⋮ | ⋮ | ⋮ | ⋮ |

FIG. 2

ADJUSTMENT VALUE TABLE
52

| ITEM NUMBER | ITEM NAME | ADJUSTMENT VALUE | CHANGE FLAG |
|---|---|---|---|
| c1 | MAXIMUM ENGINE ROTATIONAL FREQUENCY | 1.5 | 0 |
| c2 | MIDDLE ENGINE ROTATIONAL FREQUENCY | 1.2 | 0 |
| c3 | LOW ENGINE ROTATIONAL FREQUENCY | 0.9 | 0 |
| c4 | IDLE ENGINE ROTATIONAL FREQUENC | 0.8 | 1 |
| c5 | HOIST DOWN ADJUSTMENT IN HOOK OUT | 3.0 | 1 |
| c6 | RAISING ADJUSTMENT IN HOOK OUT | 3.0 | 0 |
| c7 | TURNING ADJUSTMENT IN HOOK IN/OUT | 4.0 | 0 |
| c8 | FIXED HEIGHT | 4.0 | 1 |
| c9 | ROOT HEIGHT OFFSET | 0.0 | 0 |
| c10 | WINCH DRUM ROTATION SPEED ZERO ADJUSTMENT | 50.0 | 0 |
| c11 | CONTRACTION, LOWERING PUMP DISCHARGE AMOUNT COEFFICIENT OF PARALLEL AND HORIZONTAL MOVEMENT | 0.80 | 0 |
| c12 | OFFSET GENTLY RAISED STOP TIME OF PARALLEL AND HORIZONTAL MOVEMENT | 2.00 | 0 |
| c13 | LOWERING, TURNING OPERATION AMOUNT LIMITATION OF PARALLEL AND HORIZONTAL MOVEMENT | 4.0 | 0 |
| c14 | RAISING OPERATION AMOUNT LIMITATION OF PARALLEL AND HORIZONTAL MOVEMENT | 3.0 | 0 |
| ⋮ | ⋮ | ⋮ | ⋮ |

FIG. 6

ADJUSTING DEVICE FOR OPERATING MACHINES

CROSS REFERENCE TO PRIOR APPLICATION

This application is a National Stage Patent Application of PCT International Patent Application No. PCT/JP2016/000845 (filed on Feb. 18, 2016) under 35 U.S.C. § 371, which claims priority to Japanese Patent Application No. 2015-059701 (filed on Mar. 23, 2015), which are all hereby incorporated by reference in their entirety.

TECHNICAL FIELD

The present invention relates to an adjusting device of a work machine. In particular, the present invention relates to an adjusting device for changing adjustment values of a work machine.

BACKGROUND ART

PTL 1 discloses a configuration of changing various adjustment values of a crane with an operation of a remote controlling transmitter. To be more specific, by repeating an operation of a hook up/down lever to put a cursor on an item which should be changed, and push a hook retraction/set button. Then, the screen is changed to a change screen of the designated item. Next, the operation of the hook up/down lever is repeated to change a value, and the hook retraction/set button is pushed to thereby register a new adjustment value.

CITATION LIST

Patent Literature

PTL 1
Japanese Patent Application Laid-Open No. 2000-296985

SUMMARY OF INVENTION

Technical Problem

In the case where the number of the adjustment items is small, the operator can readily determine the changed adjustment item, and therefore omission of change and error in change do not easily occur. In recent years, however, the functions of work machines are increasing, and accordingly the number of adjustment items is increasing. As a result, the operator cannot completely determine the changed adjustment items, and consequently omission of change and error in change can possibly occur.

To solve the above-mentioned problems, an object of the present invention is to provide an adjusting device of a work machine which achieves easy confirmation of the changed adjustment item.

Solution to Problem

An adjusting device of a work machine of a first aspect of the present invention is a device for changing adjustment values of a plurality of adjustment items of the work machine, the adjusting device including: a control section; an input section connected with the control section; and a display section connected with the control section. The control section stores an item ID and an adjustment value of each of the plurality of adjustment items, when a change operation from the input section is received, the control section changes an adjustment value of an adjustment item designated by the change operation to a value designated by the change operation, and when a change completion operation from the input section is received, the control section indicates on the display section an item ID and an adjustment value corresponding to an adjustment item whose adjustment value is changed.

In an adjusting device of the work machine according to a second aspect of the present invention, in the first aspect, the control section stores a last adjustment value of each of the plurality of adjustment items; and when a change completion operation from the input section is received, the control section indicates on the display section an item ID and an adjustment value corresponding to an adjustment item whose adjustment value is different from a last adjustment value.

In an adjusting device of the work machine according to a third aspect of the present invention, in the first aspect, the control section stores a change flag of each of the plurality of adjustment items; when a change operation from the input section is received, the control section changes a change flag of an adjustment item designated by the change operation to represent a change; and when a change completion operation from the input section is received, the control section indicates on the display section an item ID and an adjustment value corresponding to an adjustment item whose change flag represents a change.

In an adjusting device of the work machine according to a fourth aspect of the present invention, in the first to third aspects, when a change completion operation from the input section is received, the control section sequentially indicates on the display section only an adjustment item whose adjustment value is changed.

In an adjusting device of the work machine according to a fifth aspect of the present invention, in the first to third aspects, when a change completion operation from the input section is received, the control section indicates a part or all of the plurality of adjustment items on the display section such that an adjustment item whose adjustment value is changed and an adjustment item whose adjustment value is not changed are discriminatingly indicated.

Advantageous Effects of Invention

According to the first, second and third aspects, the adjustment item which is changed after the change operation is completed is indicated, and thus the confirmation work is easily performed. Therefore, omission of change and error in change can be reduced.

According to the fourth aspect, only the changed adjustment item is indicated, and thus the changed adjustment item can be easily confirmed. In addition, since the adjustment items are sequentially indicated, it is possible to indicate the items even with a display section which can indicate only a small amount of information.

According to the fifth aspect, the changed adjustment item and the unchanged adjustment item are discriminatingly indicated, and thus the changed adjustment item can be confirmed.

BRIEF DESCRIPTION OF DRAWINGS

FIG. 2 illustrates adjustment value table 52 of the first embodiment;

FIG. 6 illustrates adjustment value table 52 of a second embodiment;

DESCRIPTION OF EMBODIMENTS

Now embodiments of the present invention are described with reference to the accompanying drawings.

First Embodiment

Adjusting device 1 according to the first embodiment of the present invention is provided in loading truck crane CR. Adjusting device 1 is used for changing the adjustment values of the adjustment items of loading truck crane CR.

(Loading Truck Crane CR)

First, a configuration of loading truck crane CR is described.

Figure 7:
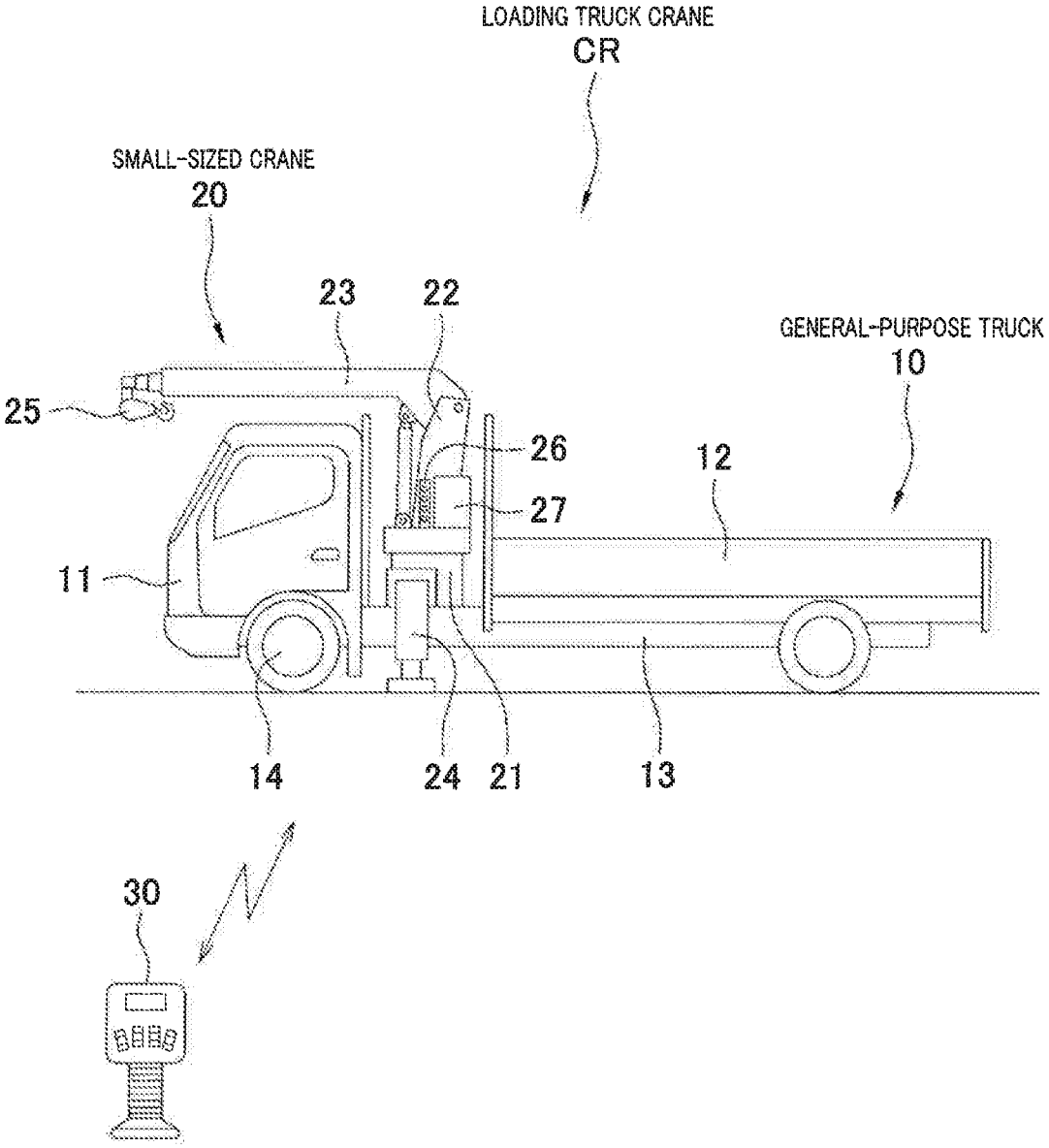
FIG. 7 is a side view of loading truck crane CR.

As illustrated in FIG. 7, in loading truck crane CR is a crane in which small-sized crane 20 is disposed in vehicle frame 13 between cab 11 and cargo bed 12 of general-purpose truck 10.

Small-sized crane 20 includes base 21 fixed on vehicle frame 13, post 22 that is slewable with respect to base 21, boom 23 provided at the upper end portion of post 22 such that boom 23 can be raised and lowered, and a pair of outrigger devices 24 provided on the left and right sides of base 21.

A winch is incorporated in post 22. A wire rope is guided from the winch to the leading end portion of boom 23, and is provided around hook 25 through a pulley of the leading end portion of boom 23 to suspend hook 25 from the leading end portion of boom 23. These crane devices are hydraulically-operated with a hydraulic circuit. Lever group 26 for operating the hydraulic circuit is provided on the left and right sides of base 21. In addition, control device 27 for electrically controlling the hydraulic circuit is provided at a position near lever group 26.

Control device 27 can bidirectionally communicate with remote operation terminal 30 through radio communications or wire communications. An input section such as various switches and levers, and a display section such as a liquid crystal panel are disposed in remote operation terminal 30. When the operator operates the input section of remote operation terminal 30, remote operation terminal 30 outputs an operation signal to control device 27, and control device 27 controls the hydraulic circuit to operate the crane device based on the operation signal. In this manner, the operator can remotely operate the crane device by use of remote operation terminal 30.

Figure 8:
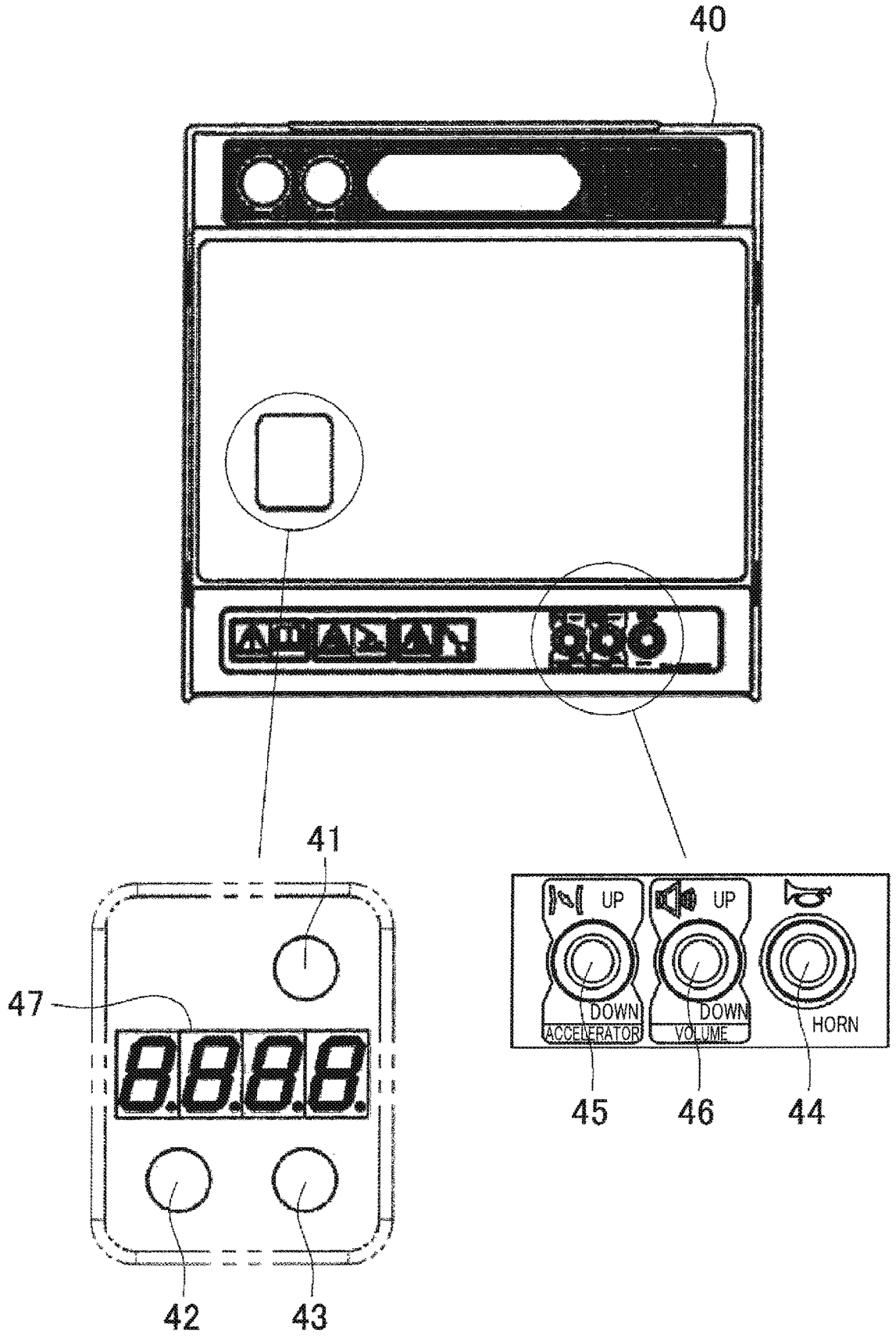
FIG. 8 is an explanatory diagram of operation panel 40.

The front face of control device 27 is operation panel 40 as illustrated in FIG. 8. Operation panel 40 includes maintenance mode switch 41, AML mode switch 42, adjustment mode switch 43, horn switch 44, accelerator toggle switch 45, and volume toggle switch 46. In addition, operation panel 40 includes 4-digit seven-segment display 47.

Loading truck crane CR includes various adjustment items. For example, "maximum engine rotational frequency," "middle engine rotational frequency," "low engine rotational frequency," "idle engine rotational frequency" and the like are provided as items relating to the engine rotational frequency. In addition, "hoist down adjustment in hook out," "raising adjustment in hook out," "turning adjustment in hook in/out" and the like are provided as items relating to automatic retraction and extension of the boom. Further, "fixed height," "root height offset" and the like are provided as items relating to the height limitation of the boom. Further, "winch drum rotation speed zero adjustment," "contraction, lowering pump discharge amount coefficient of parallel and horizontal movement," "offset gently raised stop time of parallel and horizontal movement," "lowering, turning operation amount limitation of parallel and horizontal movement," "raising operation amount limitation of parallel and horizontal movement" and the like are provided as items relating to parallel and horizontal movement of lifting cargos.

The above-mentioned adjustment items are adjusted at shipment of loading truck crane CR and the like. For example, in the case of loading truck crane CR, various general-purpose trucks 10 in which small-sized crane 20 is disposed are selected. In view of this, various engines can possibly be used as an engine for rotating the hydraulic pump provided in the hydraulic circuit. Therefore, items relating to the engine rotational frequency are adjusted to obtain an engine rotational frequency suitable for the hydraulic pump.

(Adjusting Device 1)

Next, adjusting device 1 of the present embodiment is described.

Figure 1:
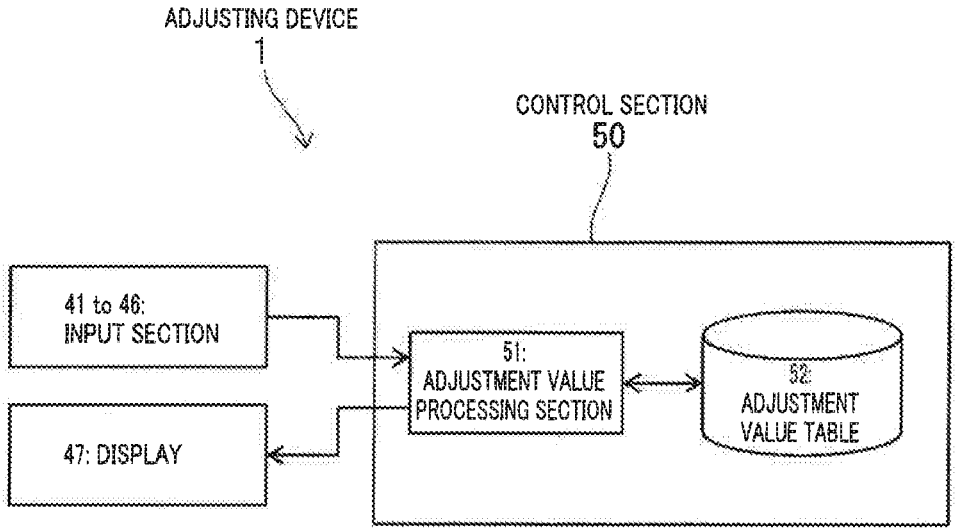
FIG. 1 is a block diagram of adjusting device 1 according to a first embodiment.

As illustrated in FIG. 1, adjusting device 1 includes control section 50, input sections 41 to 46, and display section 47. In addition, control section 50 includes adjustment value processing section 51 and adjustment value table 52. Control section 50 is disposed as a function of control device 27. More specifically, control device 27 is a computer composed of a CPU, a memory and the like. Adjustment value processing section 51 is achieved when the CPU of control device 27 executes software stored in the memory. In addition, adjustment value table 52 is stored in the memory of control device 27.

Input sections 41 to 46 are maintenance mode switch 41, AML mode switch 42, adjustment mode switch 43, horn switch 44, accelerator toggle switch 45, and volume toggle switch 46 which are provided in operation panel 40. Display section 47 is seven-segment display 47 provided in operation panel 40. Input sections 41 to 46 and display section 47 are connected with control section 50.

FIG. 2 illustrates a configuration of adjustment value table 52. Adjustment value table 52 is composed of "item number," "item name," "adjustment value," "last adjustment value." In adjustment value table 52, the item number, the item name, the adjustment value and the last adjustment value of each of a plurality of adjustment items are stored. The item numbers uniquely denote respective adjustment items. The item names are names of respective adjustment items. The adjustment values are present adjustment values set to respective adjustment items. The last adjustment values are the set adjustment values of respective adjustment items of the last time.

It is to be noted that, in the present embodiment, the item number corresponds to "item ID" of the claims. The item ID is not limited to the item number, and may be numerical values and/or character strings which can represent adjustment items. For example, the item name may be used as the item ID. Further, the values in FIG. 2 are example values.

Next, a process of adjustment value processing section 51 is described with reference to the flowchart of FIG. 3.

First, a change starting operation is performed by an operator (step S100). Here, adjustment value processing section 51 receives a change starting operation from input sections 41 to 46. For example, a long-depression of adjustment mode switch 43 for two seconds or greater is set as the change starting operation.

Then, adjustment value processing section 51 indicates the advancement to the adjustment mode on display section 47 (step S200). For example, adjustment value processing section 51 indicates "cc" on display section 47.

Next, adjustment value processing section 51 performs a preparation process (step S300). To be more specific, adjustment value processing section 51 updates the last adjustment value of each adjustment item of adjustment value table 52 to the adjustment value.

Next, adjustment value processing section 51 performs a changing process (step S400). The adjustment value is changed in the changing process. Details of the changing process are described later.

After the changing process is completed, adjustment value processing section 51 performs a confirmation indication process (step S500). adjustment value processing section 51 indicates the adjustment value changed in the confirmation indication process on display section 47. Details of the confirmation indication process are described later.

Figure 4:
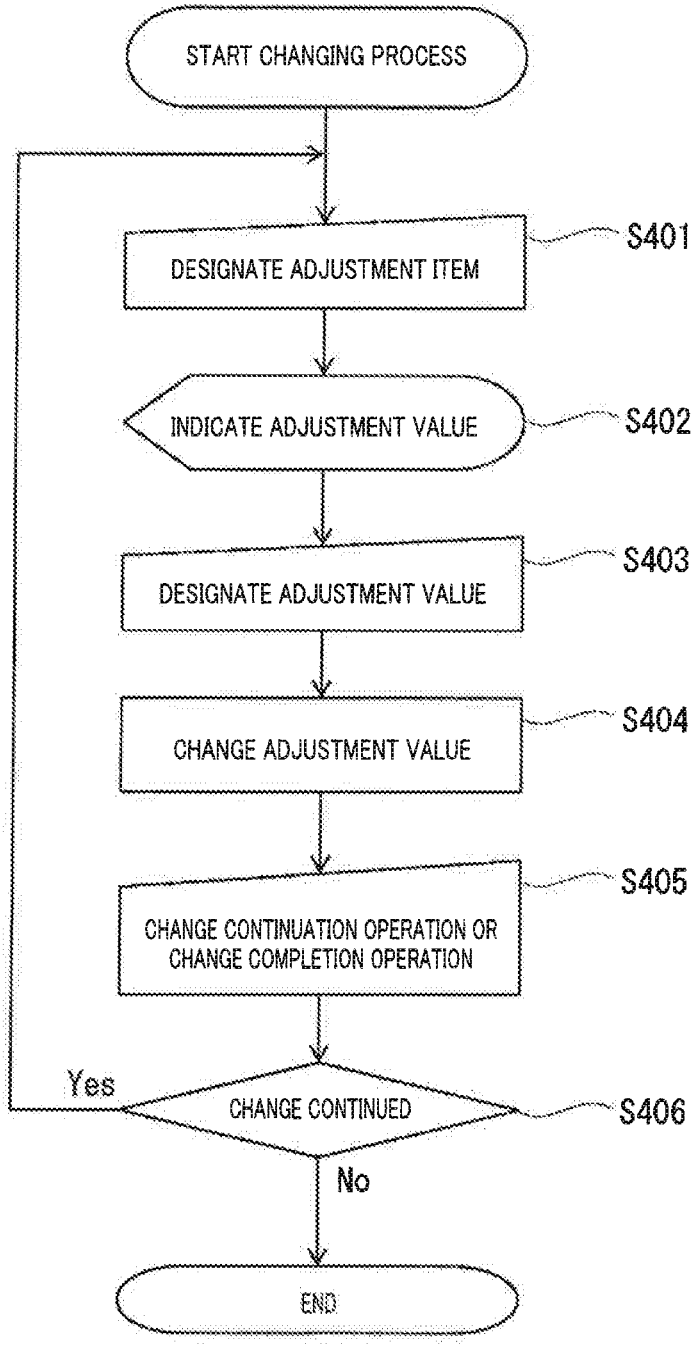
FIG. 4 is a flowchart of a changing process.

As illustrated in FIG. 4, the changing process (step S400) is performed in the following manner.

First, the adjustment item is designated by the operator (step S401). For example, the first item number "c1" is indicated on display section 47. Every time when volume toggle switch 46 is operated, the item number indicated on display section 47 is switched in the ascending order or the descending order. Volume toggle switch 46 is operated by the operator until the item number of adjustment item required to be changed is indicated on display section 47. When horn switch 44 is pushed in the state where the desired item number is indicated on display section 47, that adjustment item is designated. In the case where the adjustment value of the idle engine rotational frequency is to be changed, horn switch 44 is pushed in the state where the item number of the idle engine rotational frequency "c4" is indicated on display section 47.

Next, adjustment value processing section 51 acquires the adjustment value of the designated adjustment item from adjustment value table 52, and indicates the value on display section 47 (step S402). In the case where the idle engine rotational frequency is designated, the adjustment value of the idle engine rotational frequency "0.6" is indicated on display section 47.

Next, the operator designates the adjustment value (step S403). For example, every time when volume toggle switch 46 is operated, the adjustment value indicated on display section 47 is switched in the ascending order or the descending order. Volume toggle switch 46 is operated by the operator until an appropriate adjustment value is indicated on display section 47. When horn switch 44 is pushed in the state where the desired adjustment value is indicated on display section 47, that adjustment value is designated. In the case where the adjustment value of the idle engine rotational frequency is to be changed to 0.8, horn switch 44 is pushed in the state where the value after the change "0.8" is indicated on display section 47.

Next, adjustment value processing section 51 changes the adjustment value of the designated adjustment item in adjustment value table 52 to the designated value (step S404). In the case where the adjustment value of the idle engine rotational frequency is to be changed to 0.8, adjustment value processing section 51 changes the adjustment value of the idle engine rotational frequency to 0.8 in adjustment value table 52.

The operation of designating the adjustment item (step S401) and the operation of designating the adjustment value (step S403) are collectively referred to as "change operation." The procedure of the change operation is not limited to the above-mentioned procedure as long as the adjustment value of the adjustment item designated by the change operation can be changed to the value designated by the change operation in the case where adjustment value processing section 51 receives a change operation from input sections 41 to 46.

Next, adjustment value processing section 51 receives a change continuation operation or a change completion operation (step S405). For example, pressing of horn switch 44 is set as the change continuation operation, and pressing of adjustment mode switch 43 is set as the change completion operation.

When the change continuation operation is received from input sections 41 to 46, the process is again returned to step S401 (step S406). In this case, it suffices that the item number indicated at first on display section 47 at step S401 is the item number of the adjustment item designated at the last step S401.

By repeating steps S401 to S406, the adjustment values of a plurality of adjustment items can be changed. In an example case where the idle engine rotational frequency is changed from 0.6 to 0.8, the hoist down adjustment in hook out is changed from 2.0 to 3.0, and the fixed height is changed from 3.0 to 4.0, the content of adjustment value table 52 after the change is as illustrated in FIG. 2. In the three items, the idle engine rotational frequency, the hoist down adjustment in hook out, and the fixed height, the last adjustment value and the adjustment value are different from each other.

When a change completion operation is received from input sections 41 to 46 is received at step S405, adjustment value processing section 51 terminates the changing process (step S400), and performs a confirmation indication process (step S500) described next.

Figure 5:
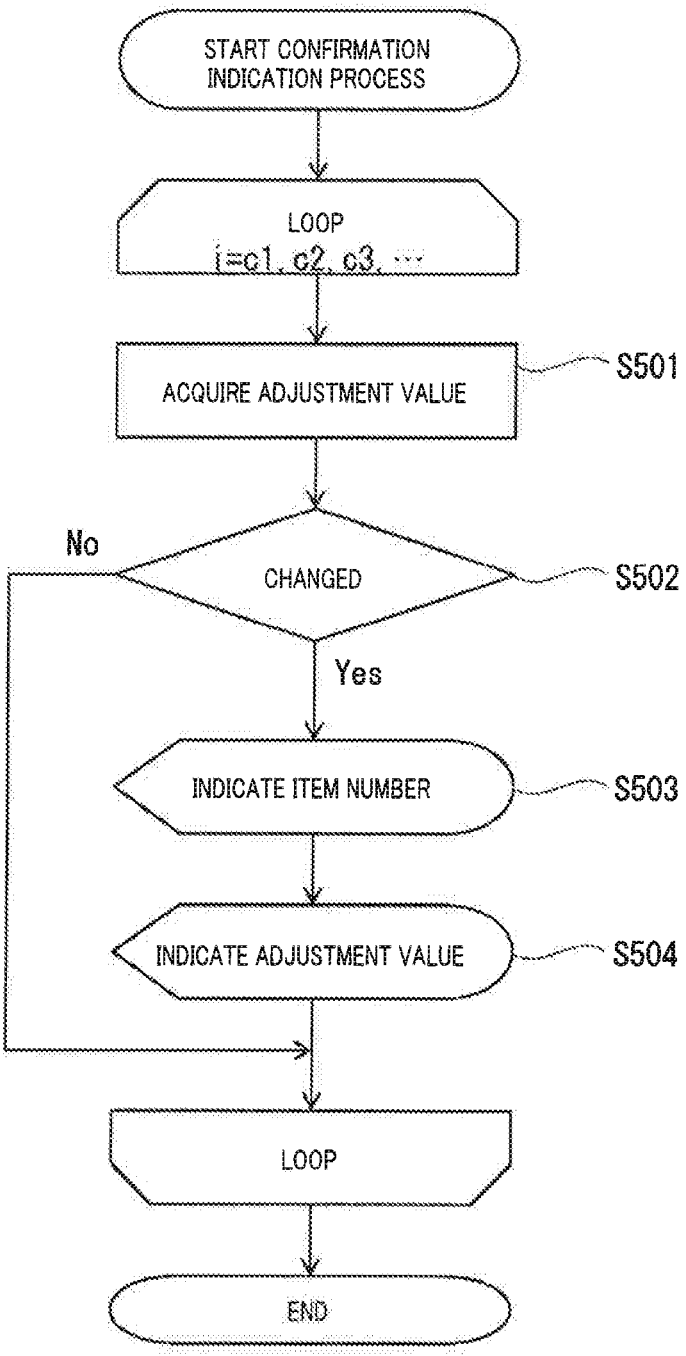
FIG. 5 is a flowchart of a confirmation indication process.

As illustrated in FIG. 5, the confirmation indication process (step S500) is performed in the following procedure.

First, adjustment value processing section 51 acquires the adjustment value and the last adjustment value of first item number (c1) from adjustment value table 52 (step S501). For example, adjustment value processing section 51 acquires adjustment value (1.5) and the last adjustment value (1.5) of the maximum engine rotational frequency.

Next, adjustment value processing section 51 compares the acquired adjustment value and the last adjustment value with each other, and determines whether the value is changed (step S502). To be more specific, when the adjustment value is different from the last adjustment value, it is determined that the value is changed, and when the adjustment value is identical to the last adjustment value, it is determined that the value is not changed. Since the adjustment value (1.5) and the last adjustment value (1.5) of the maximum engine rotational frequency of item number c1 are identical to each other, it is determined that the value is not changed.

When it is determined that the value is not changed, adjustment value processing section 51 increments the item number, and the process is returned to step S501. Then, step S501 and S502 are repeated while the item number is incremented until a changed adjustment item is found.

When it is determined that the value is changed at step S502, adjustment value processing section 51 indicates the item number corresponding to the adjustment item on display section 47 (step S503). In the case of the idle engine rotational frequency of item number c4, the adjustment value (0.8) and the last adjustment value (0.6) are different from each other, and therefore it is determined that the value is changed. Accordingly, item number "c4" is indicated on display section 47.

Subsequently, adjustment value processing section 51 indicates the adjustment value corresponding to the adjustment item whose value is determined to be changed on display section 47 (step S504). For example, the adjustment value "0.8" of the idle engine rotational frequency is indicated on display section 47.

Thereafter, adjustment value processing section 51 increments the item number, and the process is returned to step S501. When a changed adjustment item is again found, adjustment value processing section 51 indicates the adjustment value and the item number corresponding to the adjustment item on display section 47 (step S503 and S504). For example, in the case where the hoist down adjustment in hook out and the fixed height are changed, the item number "c5" and the adjustment value "3.0" of the hoist down adjustment in hook out, and the item number "c8" and the adjustment value "4.0" of fixed height are sequentially indicated.

It is to be noted that it suffices that the transition between the indication of the item number and the indication of the adjustment value is automatically performed at a given time interval. In addition, the transition may be performed in response to a predetermined operation such as pushing of horn switch 44, for example.

When step S501 to S504 are repeated and the process on the last adjustment item is completed, the confirmation indication process (step S500) is completed.

As a result, display section 47 sequentially indicates the item numbers and the adjustment values of only the adjustment items whose adjustment value is changed. Since the adjustment item which is changed after the change operation is completed is indicated in this manner, the confirmation work is easily performed. Therefore, omission of change and error in change can be reduced. In addition, even in the case where the number of adjustment items is large, the confirmation work can be performed in a short time.

Moreover, since only the changed adjustment items are indicated, the changed adjustment items can be easily confirmed. Further, since the adjustment items (item number and adjustment value) are sequentially indicated, it is possible to indicate the information even with seven-segment display 47 which can indicate only a small amount of information.

Second Embodiment

Next, an adjusting device according to the second embodiment of the present invention is described.

The configuration of the adjusting device of the present embodiment is similar to that of adjusting device 1 of the first embodiment, and the adjusting device of the present embodiment includes control section 50, input sections 41 to 46, and display section 47. In addition, control section 50 includes adjustment value processing section 51 and adjustment value table 52 (see FIG. 1).

The present embodiment is different from the first embodiment in the configuration of adjustment value table 52. As illustrated in FIG. 6, adjustment value table 52 is composed of "item number," "item name," "adjustment value," and "change flag." In adjustment value table 52, the item number, the item name, the adjustment value and the change flag of each of a plurality of adjustment items are stored. The change flag indicates whether the value of the adjustment item is changed. For example, 1 is defined as a change, and 0 is defined as no change.

Figure 3:
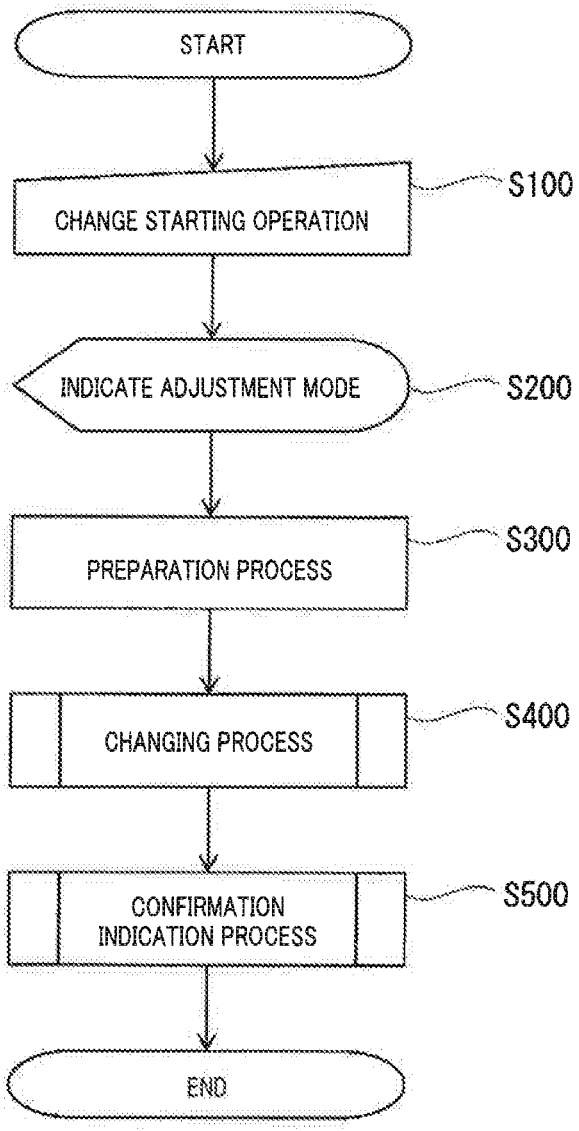
FIG. 3 is an overall flowchart of adjustment value processing section 51.

Next, with reference to the flowchart of FIG. 3, a process of adjustment value processing section 51 is described.

The processes of the change starting operation (step S100) and the adjustment mode display (step S200) are identical to those of the first embodiment. In the present embodiment, at a preparation process (step S300), adjustment value processing section 51 updates the change flag of each adjustment item of adjustment value table 52 to "no change" (0).

The changing process (step S400) illustrated in FIG. 4 is identical to the first embodiment except for the change of the adjustment value (step S404). In the present embodiment, at the change of the adjustment value (step S404), adjustment value processing section 51 changes the adjustment value of the designated adjustment item to the designated value in adjustment value table 52, and changes the change flag of the adjustment item to "changed" (1).

By repeating steps S401 to S406 of the changing process (step S400), the adjustment values of a plurality of adjustment items can be changed. In an example case where the idle engine rotational frequency, the hoist down adjustment in hook out, and the fixed height are changed, the content of adjustment value table 52 after the change is as illustrated in FIG. 6. The change flags of the three items of the idle engine rotational frequency, the hoist down adjustment in hook out, and the fixed height are set to "changed" (1).

In the confirmation indication process (step S500) illustrated in FIG. 5, adjustment value processing section 51 acquires the adjustment value and the change flag from adjustment value table 52 (step S501), and whether the value is changed is determined based on the value of the change flag (step S502). To be more specific, when the change flag is "changed" (1), adjustment value processing section 51 determines that the value is changed, and when the change flag is "no change" (0), it is determined that the value is not changed. The item number indication (step S503) and the adjustment value indication (step S504) are identical to those of the first embodiment.

As a result, display section 47 sequentially indicates the item numbers and the adjustment values of only the adjustment items whose adjustment value is changed. For example, in the case where the idle engine rotational frequency, the hoist down adjustment in hook out and the fixed height are changed, the item number "c4" and the adjustment value "0.8"' of the idle engine rotational frequency, the item number "c5" and the adjustment value "3.0" of the hoist down adjustment in hook out, and the item number "c8" and the adjustment value "4.0" of the fixed height are sequentially indicated.

Since the adjustment item which is changed after the change operation is completed is indicated in this manner, the confirmation work is easily performed. Therefore, omission of change and error in change can be reduced. In addition, even in the case where the number of adjustment items is large, the confirmation work can be performed in a short time.

Moreover, since only the changed adjustment items are indicated, the changed adjustment items can be easily confirmed. Further, since the adjustment items (item number and adjustment value) are sequentially indicated, it is possible to indicate the information even with seven-segment display 47 which can indicate only a small amount of information.

Other Embodiments

Display section 47 is not limited to a seven-segment display, and may be a liquid crystal panel or the like. With such a configuration, the amount of the information to be indicated on display section 47 can be increased. In this case, in the confirmation indication process (step S500), the following configuration may be adopted in place of the configuration of the above-mentioned embodiment in which the item numbers and the adjustment values of only the adjustment items whose adjustment value is changed are sequentially indicated.

Specifically, the information of a plurality of adjustment items is indicated on display section 47. For example, the item numbers, the item names, and adjustment values of a plurality of adjustment items are indicated in a list. At this time, all adjustment items may be indicated, or a part of the adjustment items, for example, the first half of the adjustment items, may be indicated. Then, the adjustment item whose adjustment value is changed and the adjustment item whose adjustment value is not changed are discriminatingly indicated. For example, the letter color, font size, typeface, background color and the like of the adjustment item whose adjustment value is changed are indicated in an eye-catching manner.

With this configuration, the changed adjustment item and the unchanged adjustment item can be discriminated from each other, and accordingly the changed adjustment items can be easily confirmed.

The input section may be switches 41 to 46 provided in operation panel 40, or an input section provided in remote operation terminal 30. The display section may be display section 47 provided in operation panel 40, or a display section provided in the remote operation terminal.

The adjusting device of the work machine according to the present invention is provided in various work machines including mobile cranes, fixed cranes, high lift working vehicles, wheel loaders, and hydraulic excavators. Examples of the mobile cranes include all-terrane cranes, rough-terrane cranes, truck cranes, loading truck cranes and the like.

REFERENCE SIGNS LIST

1 Adjusting device
40 Operation panel
41 to 46 Input section
47 Display section
50 Control section
51 Adjustment value processing section
52 Adjustment value table

The invention claimed is:

1. An adjusting device of a work machine having a hydraulic circuit for changing adjustment values of a plurality of adjustment items related to a hydraulic operation of the work machine, the adjusting device comprising:

a control section;

an input section connected with the control section; and a display section connected with the control section, wherein:

the plurality of adjustment items include at least two of at least one item relating to engine rotation frequency of the work machine, at least one item relating to automatic retraction and extension of a boom of the work machine, at least one item relating to height limitation of the boom of the work machine, or at least one item relating to movement of lifting cargos of the work machine, the display section comprises a seven-segment display, the control section is configured to:

store a plurality of item identifiers for identifying the plurality of adjustment items respectively and an adjustment value which is a value changeable by the input section for each of the plurality of adjustment items, when a change starting operation for starting a change of the adjustment value is received from the input section, be transferred to an adjusting mode and indicate one item identifier of the plurality of item identifiers on the seven-segment display, every time an item identifier switching operation for switching one item identifier to be indicated on the seven-segment display is received from the input section in the adjusting mode, switch one item identifier to be indicated on the seven-segment display such that the plurality of item identifiers are sequentially indicated one by one, when an adjustment item designating operation for designating one adjustment item identified by one item identifier currently indicated on the seven-segment display is received from the input section in the adjusting mode, indicate the adjustment value of the one designated adjustment item instead of one item identifier corresponding to the one designated adjustment item, when a change operation for changing the adjustment value is received from the input section in the adjustment mode, change a value currently indicated on the seven-segment display as the adjustment value according to the change operation, when a change completion operation for terminating the change of the adjustment value is received from the input section in the adjusting mode, terminate the adjusting mode and sequentially indicate on the seven-segment display the one item identifier and the adjustment value corresponding to the one adjustment item whose adjustment value is changed, and when the change completion operation from the input section is received in the adjusting mode, indicate a part or all of the plurality of adjustment items on the seven-segment display such that an adjustment item whose adjustment value is changed and an adjustment item whose adjustment value is not changed are discriminatingly indicated.

2. The adjusting device of the work machine according to claim 1, wherein:

the control section is further configured to:

store a last adjustment value of each of the plurality of adjustment items; and when the change completion operation from the input section is received in the adjusting mode, determine that an adjustment item whose adjustment value is different from the last adjustment value is an adjustment item whose adjustment value is changed.

3. The adjusting device of the work machine according to claim 1, wherein:

the control section is further configured to:

store a change flag of each of the plurality of adjustment items;

when the change operation from the input section is received in the adjusting mode, change a change flag of an adjustment item designated by the change operation to represent a change; and when the change completion operation from the input section is received in the adjusting mode, determine that an adjustment item whose change flag represents a change is an adjustment item whose adjustment value is changed.

4. The adjusting device of the work machine according to claim 1, wherein:

the control section is further configured to:

when a change continuation operation for continuing the change of the adjustment value, indicate one item identifier of the plurality of item identifiers for next item identifier switching operation and next change operation from the input section, and when the change completion operation from the input section is received in the adjusting mode, sequentially indicate on the seven-segment display only an adjustment item whose adjustment value is changed.

5. The adjusting device of the work machine according to claim 1, wherein the seven-segment display is a 4-digit seven-segment display.

* * * * *